United States Patent [19]

Hwang et al.

[11] 4,162,158

[45] Jul. 24, 1979

[54] FERRITIC Fe-Mn ALLOY FOR CRYOGENIC APPLICATIONS

[75] Inventors: Sun-Keun Hwang, Rockypoint, N.Y.; John W. Morris, Jr., Berkeley, Calif.

[73] Assignee: The United States of America as represented by the United States Department of Energy, Washington, D.C.

[21] Appl. No.: 973,844

[22] Filed: Dec. 28, 1978

[51] Int. Cl.[2] ..... C22C 38/04

[52] U.S. Cl. ..... 75/124; 75/123 B; 75/123 N; 75/123 M

[58] Field of Search ..... 75/124, 123 B, 123 N, 75/123 M; 148/37

[56] References Cited

U.S. PATENT DOCUMENTS

| | | | |
|---|---|---|---|
| 3,330,651 | 7/1967 | Younkin | 75/123 N |

FOREIGN PATENT DOCUMENTS

| | | | |
|---|---|---|---|
| 25741 | of 1910 | United Kingdom | 75/123 N |
| 516054 | of 1939 | United Kingdom | 75/123 N |
| 675265 | 7/1952 | United Kingdom | 75/123 N |
| 322399 | 2/1972 | U.S.S.R. | 75/123 N |

*Primary Examiner*—Arthur J. Steiner

*Attorney, Agent, or Firm*—Dean E. Carlson; R. S. Gaither; William S. Bernheim

[57] ABSTRACT

A ferritic, nickel-free alloy steel composition, suitable for cryogenic applications, which consists essentially of about 10–13% manganese, 0.002–0.01% boron, 0.1–0.5% titanium, 0–0.05% aluminum, and the remainder iron and incidental impurities normally associated therewith.

2 Claims, 1 Drawing Figure

FERRITIC Fe-Mn ALLOY FOR CRYOGENIC APPLICATIONS

BACKGROUND OF THE INVENTION

The invention described herein was made at the Lawrence Berkeley Laboratory under United States Department of Energy Contract No. W-7405-ENG-48 with the University of California.

This invention relates to an alloy steel composition, in particular, an alloy steel composition suitable for cryogenic applications.

Due to the dwindling of natural gas supplies in this country and in other countries, especially those countries near the large users of natural gas, there is considerable interest in means for safely transporting liquefied natural gas (LNG) by ship and by other transportation. The LNG containers must be designed to avoid breakage due to pressure increase and crack development at cryogenic temperatures. The danger of a catastrophic explosion and fire is always present when dealing with LNG.

At cryogenic temperatures (generally below about −80° to −100° C.), ordinary steel alloys lose much of their toughness and become very brittle. The steels now commonly specified for structural applications at LNG and lower temperatures, 9% Ni steel, austenitic stainless steels, and invar alloys, have in common a relatively high content of nickel. While the nickel alloy addition contributes significantly to the good low temperature properties of these alloys, it also adds substantially to the cost. Recently 5–6% Ni steels have been introduced in response to this need. Further decreases in the acceptable nickel content would be desirable.

In addition, there is a voluminous market for cryogenic alloys in storage systems for other liquefied gases, particularly nitrogen, oxygen, and liquid air. The standards for these applications are less stringent than those for LNG and thus the steel used should have lower production costs to compete with other alloys.

Of the common alloying elements in steel, manganese is the most attractive as a substitute for nickel in cryogenic alloys. Manganese is readily available, relatively inexpensive, and has a metallurgical similarity to nickel in its effect on the microstructures and phase relationships of iron-based alloys. Therefore, there has been considerable interest in the potential of Fe-Mn alloys for cryogenic use. However, research on Fe-Mn alloys has not yet led to industrial application in cryogenic service. It has been found that Fe-12 Mn alloys can be made tough at 77 K by a cold work plus tempering treatment which suppresses intergranular fracture. More recently, it has been shown that the intergranular fracture of Fe-12 Mn can also be eliminated by controlling cooling through the martensite transformation yielding an alloy with reasonable toughness at 77 K in the as-cooled condition. The treatment is, however, fairly slow and requires critical temperature control.

A brief survey of current research in Fe-Mn alloys for cryogenic applications is presented in J. W. Morris, Jr., et al, "Fe-Mn Alloys for Cryogenic Uses: A Brief Survey of Current Research" which has been submitted to *Advances in Cryogenic Engineering* for publication and is currently in press.

SUMMARY OF THE INVENTION

The present invention provides a nickel-free Fe-Mn alloy steel composition, which has a very low ductile-brittle transition temperature after conventional air cooling from austenitizing treatment, which has less than half the total alloy content as compared to austenitic cryogenic steels, and which has a high level of cryogenic strength and toughness. The present steel is ferritic in structure and has the composition, by weight, of about 10–13% manganese, about 0.002–0.01% boron, about 0.1–0.5% titanium, about 0–0.5% aluminum, and the remainder iron and incidental impurities normally associated therewith. It has been found that the inclusion of boron eliminates the need for slow, controlled cooling, thus significantly reducing the production costs of the present steel.

It is, therefore, an object of this invention to provide an alloy steel composition suitable for cryogenic applications.

More particularly, it is an object of this invention to provide a nickel-free alloy steel composition for cryogenic use.

Another object of this invention is to provide an alloy steel composition suitable for cryogenic use which can be tempered by conventional rapid cooling techniques.

Other objects and advantages will become apparent from the following detailed description made with reference to the accompany drawing.

DETAILED DESCRIPTION OF THE INVENTION

Figure 1:
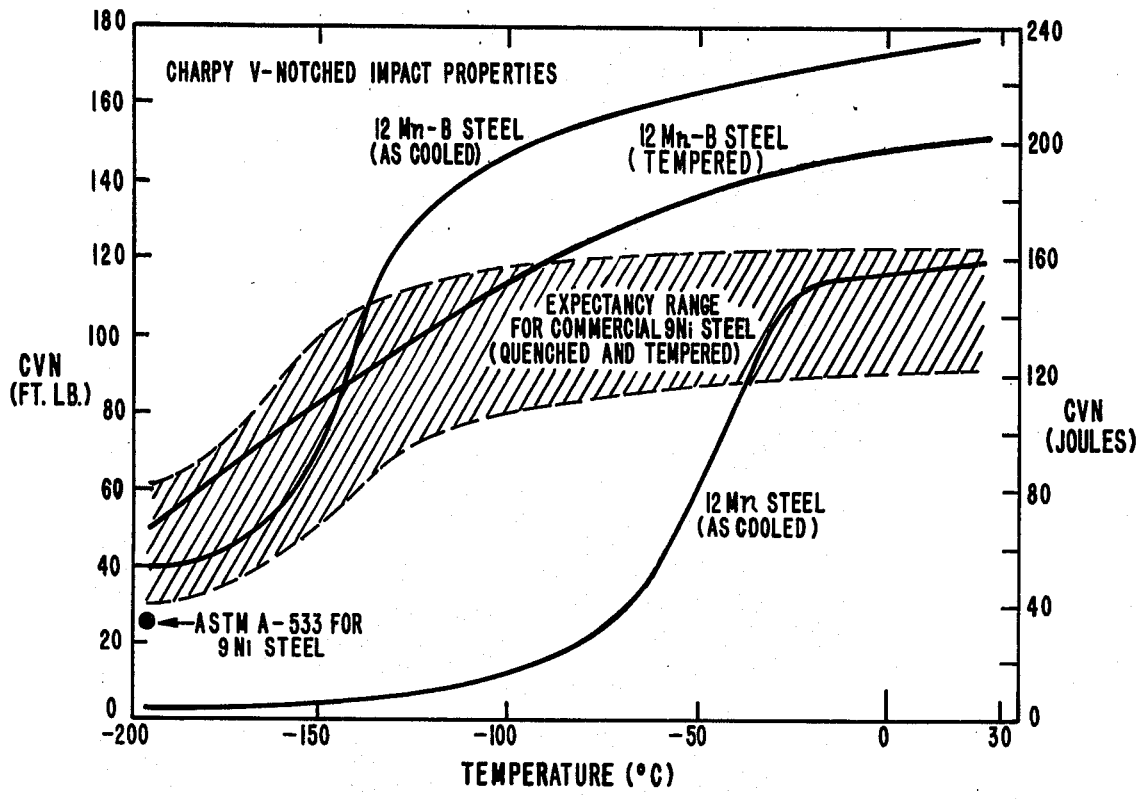
FIG. 1 is a graph comparing Charpy V-notched impact properties of a particular steel of the present invention with 9 Ni steels and a 12 Mn steel which does not contain boron.

The alloy steel of the present invention has the economic advantage of being Ni-free, yet it performs competitively with 9 Ni steel in cryogenic testing. This result has been achieved by the addition of a small amount, of the order of about 0.002–0.01%, of boron to an Fe-Mn alloy having a manganese content of about 10–13%. The presence of boron apparently suppresses the intergranular fracture of these alloys, thereby lowering the ductile-brittle transition temperature and improving toughness at temperatures as low as 77 K (liquid nitrogen temperature). It is important that the boron content be below about 0.01% since at higher levels, precipitates begin to form at grain boundaries which tends to promote brittleness.

The present steel composition also contains 0.1–0.5% titanium and up to about 0.05% aluminum. The presence of these elements is generally advantageous in Fe-Mn alloys for controlling interstitial impurities in the melt.

The following example is illustrative of the present invention.

EXAMPLE

An alloy steel having the following nominal composition by weight was prepared and tested for cryogenic applications: 12% manganese, 0.002% boron, 0.1% titanium, 0.05% aluminum, and the remainder iron and incidental impurities. The composition was tested in the as cooled (austenitizing at 1000° for 40 minutes followed by air cooling) and in the tempered (after austenitizing-/air cooling, tempered at 550° for 1 hour followed by water quenching) condition. The results, compared with a 9 Ni steel and with a comparable Fe-Mn steel containing no boron, are given in the following Table and in FIG. 1.

MECHANICAL PROPERTIES COMPARISON

| | Ultimate Tensile Strength (ksi[MPa]) | | Yield Strength (ksi[MPa]) | | Elongation (%) | | V-notch Impact Toughness (ft-lb [Joules]) | |
|---|---|---|---|---|---|---|---|---|
| | at 24° C. | at −196° C. | at 24° C. | at −196° C. | at 24° C. | at −196° C. | at 24° C. | at −196° C. |
| ASTM A553 for 9Ni Steel | 100~120 [690~827] | — | 85[586] | — | 20 | — | — | 25[34] |
| Normal Expectancy in commercial 9Ni Steels* (Quench & Tempered) | 115[791] | 170[1172] | 105[722] | 125[862] | 28 | 35 | 50~100 [68~136] | 30~60 [41~82] |
| 12Mn-B Steel (as cooled) | 142[981] | 205[1414] | 92[633] | 124[854] | 26 | 26 | 61[83] | 40[54] |
| 12Mn-B Steel (tempered) | 151[1043] | 223[1549] | 106[733] | 150[1036] | 31 | 34 | 82[111] | 50[68] |
| 12Mn Steel (as cooled) | 1343[924] | 196[1351] | 87[600] | 129[889] | 25 | 25 | 6[8] | 5[7] |

12Mn-B Steel: Fe-12%Mn-0.1%Ti-0.05%Al-0.002%B
12Mn Steel: Fe-12%Mn-0.2%Ti
*Data from INCO Report A-263: "9% Nickel Steel for Low Temperature Service"
—Not specified It is evident from the results shown that the present steel compares favorably with 9 Ni steel for cryogenic applications and that the inclusion of boron significantly improves the impact toughness of an Fe-12 Mn steel at cryogenic temperatures.

Although the invention has been hereinbefore described with reference to specific examples, it is to be understood that various changes and modifications will be obvious to those skilled in the art.

What we claim is:

1. A ferritic alloy steel composition consisting essentially of about 10–13% manganese, about 0.002–0.01% boron, about 0.1–0.5% titanium, about 0–0.05% aluminum, and the remainder iron with incidental impurities normally associated therewith.

2. A ferritic alloy steel composition according to claim 1 wherein the composition is about 12% manganese, about 0.002% boron, about 0.1% titanium, about 0.05% aluminum, and the remainder iron with incidental impurities normally associated therewith.

* * * * *